United States Patent [19]

Roman et al.

[11] 4,110,112

[45] Aug. 29, 1978

[54] PHOTOSENSITIVE MATERIAL CONTAINING 2,3-DI(2,3-DIIODOPROPOXY)-PROPYL CELLULOSE AND USES THEREOF

[75] Inventors: Alain Roman, Bossey; Jean-Pierre Sachetto, St. Julien-en-Genevois, both of France; Manfred Wust, Dardagny; Sergio Cuccolo, Geneva, both of Switzerland

[73] Assignee: Neste Oy, Espoo, Finland

[21] Appl. No.: 809,452

[22] Filed: Jun. 23, 1977

[51] Int. Cl.[2] ..... G03C 5/24; G03C 1/00

[52] U.S. Cl. ..... 96/1 PC; 96/88; 96/89; 96/90 R; 96/48 QP; 96/48 R; 96/1.5 R; 536/84; 536/99

[58] Field of Search ..... 536/84, 99, 90; 96/115 R, 88, 89, 90 R, 48 QP, 48 R, 27 R, 1.5, 1 PC

[56] References Cited

U.S. PATENT DOCUMENTS

| | | | |
|---|---|---|---|
| 3,042,518 | 7/1962 | Wainer | 96/90 R |
| 3,565,628 | 2/1971 | Garland et al. | 96/88 |

FOREIGN PATENT DOCUMENTS

| | | | |
|---|---|---|---|
| 346,806 | 4/1931 | United Kingdom | 536/84 |

OTHER PUBLICATIONS

Chem. Abs., vol. 70, 1969, 48771z.

*Primary Examiner*—Won H. Louie, Jr.
*Attorney, Agent, or Firm*—Steinberg & Blake

[57] ABSTRACT

A photosensitive material is provided in which at least one surface portion of a substrate contains 2,3-di-(2,3-diiodopropoxy)-propyl cellulose uniformly distributed therethrough. A photosensitive sheet material can be formed totally of 2,3-di-(2,3-diiodopropoxy)-propyl cellulose or in part thereof, provided that the surface thereof contains 2,3-di-(2,3-diiodopropoxy)-propyl cellulose. Upon exposure to an activating electromagnetic radiation in which the intensity is modulated according to the configuration of an image, a visible image is formed on the surface of the material. Provision is further made for bringing the surface of the material into contact with the substance which forms a colored compound upon reaction with iodine liberated upon subjecting the surface to activating electromagnetic radiation.

20 Claims, No Drawings

PHOTOSENSITIVE MATERIAL CONTAINING 2,3-DI(2,3-DIIODOPROPOXY)-PROPYL CELLULOSE AND USES THEREOF

BACKGROUND OF THE INVENTION

Various materials are known for use as photosensitive materials for the recording of an image or the like. Many such materials are dependent upon light of different wavelengths and new materials of different properties are constantly being sought.

CROSS REFERENCE TO RELATED APPLICATION

In our copending application Ser. No. 809,451 filed simultaneously herewith, entitled "2,3-Di-2,3-Diiodopropoxy)-Propyl Cellulose and Method of Producing The Same" we have described the substance 2,3-di-2,3-diiodopropoxy)-propyl cellulose and methods of producing the same, as well as the properties thereof.

SUMMARY OF THE INVENTION

Generally speaking, in accordance with the present invention, a photosensitive material is provided in which at least a surface of at least one face contains 2,3-di-(2,3-diiodopropoxy)-propyl cellulose uniformly distributed therethrough. Upon exposure to electromagnetic radiation the intensity of which is modulated according to contours of an image, an image appears in visible form on the surface of the material.

It is accordingly a primary object of the present invention to provide a photosensitive material which can be used for recording an image.

It is another object of the present invention to provide means for producing such photosensitive material.

It is yet a further object of the present invention to provide a photosensitive material which can be used to produce images of different kinds.

It is yet another object of the present invention to provide a method of forming images using the photosensitive material of the present invention.

Other objects and advantages of the present invention will be apparent from a further reading of the specification and of the appended claims.

With the above and other objects in view, the present invention mainly comprises a photosensitive sheet material at least one surface portion of which has a 2,3-di-(2,3-diiodopropoxy)-propyl cellulose distributed therein.

The substance 2,3-di-(2,3-diiodopropoxy)-propyl cellulose, the properties of which and process for preparation of which are described in our copending application Ser. No. 809,451, filed simultaneously herewith, is a photosensitive material derived from cellulose by substitution of at least part of the substitutable alcohol groups of the cellulose by 2,3-di-(2,3-diiodopropoxy)-propyl groups. This photosensitive material of the present invention is hereinafter referred to, for simplicity, by the abbreviation "PCTI".

The substance PCTI can take various physical forms, in particular in the form of white colored fibers or the form of a transparent film.

According to one of the embodiments of the present invention, the photosensitive material of the present invention consists of a paper formed either solely from fibers of PCTI or from a mixture of cellulose paper fibers and fibers of PCTI. Preferably in using such mixture, the same should contain at least 1% by weight of PCTI.

According to another embodiment of the present invention the photosensitive material consists of a film base with film-forming polymeric material, such as polymethylmethacrylate, polyvinyl alcohol, an epoxy resin, a polyester, a phenolic resin, a cellulose polymer, etc. containing in dispersion fibers of the PCTI.

According to another embodiment of the invention, the photosensitive material consists of a homogeneous cellulosic polymer film, regenerated from an appropriate solution prepared entirely from fibers of PCTI or by mixing a solution of PCTI fibers with a solution of cellulose.

Preferably a mixture of a PCTI solution and a cellulose solution is used, and most preferably a mixture containing at least 1% by weight and up to 20% by weight of PCTI is used.

In order to form these solutions, it is possible to proceed in a manner known per se, for example using a complex solvent for cellulose, such as a mixture of nitric oxide ($N_2O_4$) and dimethylsulfoxide or dimethylformamide, or a mixture of dimethylsulfoxide and paraformaldehyde, which complex solvents for cellulose also act as solvents for the PCTI.

To regenerate a cellulosic polymer in the form of a film, starting from said solutions, it is equally possible to proceed in the manner known per se, for example using a liquid of the type known as a "hydroxylic solvent", such as methanol, or by the process known as "solvent casting".

The process for the manufacture of the photosensitive material is characterized according to the present invention by the fact that a sheet material is formed which is constituted at least in part by the PCTI, i.e. by the 2,3-di-(2,3-diiodopropoxy)-propyl cellulose.

According to one embodiment of this invention, a sheet of paper is prepared starting from a mixture of cellulose paper fibers and PCTI fibers in suspension in an appropriate aqueous liquid medium. All of the usual paper making techniques can be used for this purpose.

According to another embodiment, a film of PCTI or a mixture of PCTI and regenerated cellulose can be prepared by the well known technique known as "solvent casting", which consists in flowing a solution of the matter destined to form the film in a volatile solvent onto a smooth surface, for example a flat plate or a rotating roller, and finally evaporating the solvent.

The use of the photosensitive material of the present invention to record an image is characterized by the fact that the surface of the material is exposed to electromagnetic radiation wherein the intensity is modulated according to the configuration of the image, for a period of time sufficient to produce an image in a visible form on the surface of the material. The usual sources of activating electromagnetic radiation can be used, for example solar radiation or ultraviolet radiation. In the case of ultraviolet radiation it is possible to use a mercury vapor lamp as the source thereof.

In order to modulate the intensity of the radiation according to the configuration of the image, a screen or filter, for example, can be used. In particular, a photographic negative can be used or the image can be formed by projection using an appropriate optical system.

Regarding the duration of the exposure, this depends upon the wavelength and the intensity of the activating radiation, on the quantity of iodine in the surface of the material and on the contrast desired. Preferably the duration of the exposure is from a few tenths of a second to several minutes. This of course can be varied without great difficulties.

The image appears in the form of spots of yellow color corresponding to the radiated parts of the surface of the material. These parts are distinct, by the contrast in color, from the non-radiated parts of the surface of the material which maintain their original white coloration in the case where the material is in the form of a paper, or which remain uncolored in the case where the material is in the form of a paper, or which remain uncolored in the case where the material was in the form of a regenerated cellulose film.

By using a screen or a filter having a surface which contains areas wherein the transmission to electromagnetic radiation is between 0% and 100% , it is possible to form an image formed of spots of which the intensity varies in a continuous manner between maximal intensity and an intensity which is scarcely perceptible to the eye.

The formation of the colored spots can be attributed to the liberation from the 2,3-di-(2,3-diiodopropoxy)-propyl cellulose of iodine in the form of free radicals, under the action of the activating radiation, and to the recombination of these free radicals in the form of molecular iodine and/or ionic species such as the iodide ion ($I^+$), periodate ion ($IO_4^+$), etc.

The color of the image can be modified and/or augmented in contrast by carrying out a development having the effect of forming at least one colored compound, or by modifying the color of a colored compound by chemical or photochemical reaction of the iodine radicals and/or ionic or molecular species formed from the iodine radicals.

For example, the reaction may be a photochemical reaction or a chemical oxidation reaction of at least one organic compound with the iodine readicals or one of the species formed from the iodine radicals.

It is possible, for example, to use as an organic compound susceptible to chemical or photochemical oxidation by iodine radicals to produce an image or to modify the coloration, an aromatic amine, leuco forms of dyestuffs belonging to the diarylmethane or triarylmethane family, cyanine dyestuffs or merocyanine dyestuffs.

The aromatic amines and the leuco forms of dyestuffs belonging to the diarylmethane and triarylmethane families can, if they are incorporated in the photosensitive material before the exposure, form colored species with the iodine radicals. The substances also form colored species of molecular iodine by simple development of the iodine image in a solution of the substances.

In the two cases, and generally speaking for coloring agents obtained by chemical or photochemical oxidation, the system consists of a process of forming an image of the "positive-negative" or "negative-positive" type.

It is equally possible to obtain a positive image directly from a positive by making use of the property possessed by certain dyestuffs to become decolorized when irradiated. Under these circumstances the iodine radicals are capable, under irradiation and in the presence of dyestuffs of the cyanine and merocyanine type, for example, of oxidizing the dyestuffs to a colorless form, thus providing a means for obtaining a positive image from a positive.

Among the chemical oxidation reactions brought about by the ionic species formed from the iodine radicals, there may be mentioned the reaction of the periodate ion ($IO_4^-$) with tetramethyl-p-diamino diphenyl methane giving rise to the formation of a blue compound and the reaction of the iodide ion ($I^-$) with palladium chloride giving rise to the formation of a brown precipitate of palladium iodide.

After photochemical development and subsequent neutralization of the excess of developing agent, the photosensitive material is washed with water and then dried. There is thus obtained a colored image of high contrast, insoluble in water or organic solvents. The non-irradiated portions of the material are free from any colored substance and retain their original photosensitivity. Accordingly, it is possible to form successively on the same material several images of the same color or of different colors.

In the case where chemical development or photochemical development is not effected, it is possible to remove, in an appropriate manner, for example by dissolving in a suitable solvent such as methanol, the spots of iodine formed during an irradiation. It is thus possible to make the corresponding image disappear, and then to proceed with a new exposure of the surface of the material so as to form a new image. Such cycle of erasing and forming an image can be repeated ten times, for example, without appreciable dimunition of the contrast of the image.

It is also possible to make use of the electrostatic contrast which results from the difference in electrical conductivity between the irradiated and non-irradiated portions of the material, a difference in conductivity which arises from the liberation of iodine in the irradiated parts while the non-irradiated parts retain their original resistance, to make the image appear by an electrophotographic development process (electrostatic development under dry or wet conditions). One such process known per se consists in applying a uniform electrostatic charge to the surface of the material, then placing the face of the material opposed to that which has received this charge in contact with a substrate having an elevated electrical conductivity, for example a metal plate, the substrate being maintained at a zero potential, so as to form on the surface of the material a latent image modulated in the form of differences in the density of the electrostatic charge and finally, materializing the latent image by means of grains of "toner" (fusable colored powder which is bound to the surface of the material by electrostatic attraction and is then fused to render the image permanent).

The detailed description of one such process of electrophotographic development appears for example in the following work: Electrophotography, by R. M. Schaffert, The Focal Press, London and New York (1965).

DESCRIPTION OF PREFERRED EMBODIMENTS

The invention is further illustrated by the following examples. The scope of the invention is not, however, meant to be limited to the specific details of the examples:

EXAMPLE 1

Preparation of a Photosensitive Paper

A sheet of paper having a thickness of 60 microns is prepared by means of a machine of the usual type used in paper manufacture, using as primary matter exclusively a mixture of 10% of white photosensitive fibers of 2,3-di-(2,3-diiodopropoxy)-propyl cellulose having an iodine content of 10.14% by weight, obtained by the process described in our copending U.S. patent application Ser. No. 809,454, filed simultaneously herewith, and cellulose fibers. This manufacture is carried out in a room illuminated by a light source of which the emission spectrum does not contain radiation of wavelength less than 0.5 microns.

There is thus obtained a sheet of white paper identical in appearance to ordinary cellulosic paper. This sheet is completely insensitive to heating, even prolonged, up to a temperature of not more than 150° C, but it yellows rapidly (in a matter of seconds) as soon as it is exposed to solar radiation. On the other hand, it retains its original white color indefinitely if it is kept in the absence of electromagnetic radiation of wavelength less than or equal to 0.5 microns.

EXAMPLE 2

Preparation of a Photosensitive Film 1.5g of cellulose is suspended in 40 ml of dry DMSO (dimethylsulfoxide). The suspension thus obtained is cooled to 0° C, 2ml of $N_2O_4$ are added and the mixture is agitated and left to return to room temperature. A solution of cellulose is thus obtained. To 30.2g of this mixture there is added 0.3g of photosensitive fibers identical to those used in Example 1, which go into solution. The solution thus obtained is spread on a plate and the solvent evaporated under vacuum so as to form a transparent photosensitive film.

EXAMPLE 3

Preparation of a Photosensitive Film 1.7g of cellulose fibers are suspended in 200ml of dry DMSO. Gaseous formaldehyde is bubbled into the mixture heated to a 100° C with agitation. After a few minutes, a limpid viscous solution is obtained. 0.3g of photosensitive fibers are added to the mixture at 100° C while continuing to bubble in the gaseous formaldehyde. After 1 hour there is obtained a slightly turbid solution which is filtered. The clear solution obtained by filtration is spread on a plate and the solvent is evaporated under vacuum at 80° C. There is obtained a transparent photosensitive film which is washed with methanol in order to extract residual formaldehyde.

EXAMPLE 4

Use of the Photosensitive Material to Register an Image

A piece of the sheet of photosensitive paper prepared in the manner described in Example 1 is exposed for 2 seconds to the radiation emitted by a low pressure mercury vapor lamp (a Philips lamp, type HTQ 7 having a linear power of 28 W/cm) placed 15cm from the surface of the sheet while masking certain areas of the sheet by means of a perforated mask. The exposed parts of the sheet of photosensitive paper take on a yellow coloration. The optical density of the non-exposed parts of the paper is 0.12. The optical density of the exposed parts of the paper is 0.15. The optical density of the exposed parts varies as a function of the duration of the irradiation in the manner shown in the following table:

| Duration of irradiation: | Optical density: |
|---|---|
| 0 | 0.12 |
| 2 " | 0.15 |
| 5 " | 0.17 |
| 10 " | 0.19 |
| 30 " | 0.24 |
| 1 ' | 0.26 |
| 2 ' | 0.27 |

EXAMPLE 5

The coloration which formed on the paper in the manner described in Example 4, is erased by immersion of the paper in a bath of methanol. After drying, there is obtained a white paper having an optical density identical to the initial optical density of the paper (before irradiation). The exposure is then repeated using the same conditions with the same result. Five cycles of erasure and exposure are effected without observing any notable diminution in the contrast of the image.

EXAMPLE 6

A piece of film prepared in the manner described in Example 4 is exposed for 10 seconds using the same apparatus for radiation as in Example 4. The photosensitive film becomes colored yellow. The coloration is erased by dissolving the iodine in methanol. The film is re-exposed, after being dried, under the same conditions with the same result.

EXAMPLE 7

Modification of the Coloration and Contrast of the Image by Formation of a Colored Complex A photosensitive paper prepared in the manner described in Example 1 is exposed for 1 minute to radiation emitted by a mercury vapor U.V. lamp through a photographic negative in the manner described in Example 4. There is thus obtained the formation of a yellow image on the surface of the paper.

The paper thus given an impression is immersed in an aqueous solution containing 0.5% by weight of diamino-1,3-phenylene dihydrochloride and 1% of diamino-1,4-phenylene. The parts initially colored yellow instantaneously take on a blue/black color. The aromatic substances which have not reacted, in particular in the unexposed zones, are removed by subsequent treatment of the paper in an aqueous solution containing 1% formic acid and 0.2% ammonium persulfate. There is obtained a fixed blue image of high contrast on a white ground.

The image-bearing paper thus obtained does not give off an odor of aromatic products. This paper no longer contains free diamino-1,4-phenylene. In particular, a new irradiation in an unexposed zone leads to the formation of a yellow image.

EXAMPLE 8

A photosensitive paper prepared in the manner described in Example 1 is impregnated with an ethanolic solution of 1,4-phenylene diamine (1% by weight) and 1,3-phenylene diamine dihydrochloride (0.5%). The paper thus impregnated is irradiated under the conditions described in Example 4 and dried. There is thus obtained the formation of a blue/black image on the surface of the paper. The paper is then treated in the manner described in Example 7 to remove aromatic substances which have not reacted.

EXAMPLE 9

The leuco form of the dyestuff known under the name of malachite green (C.I. 42000), is synthesized by a reaction of dimethylaniline and benzaldehyde in the presence of concentrated sulphuric acid. After separation and recrystallization, there is obtained a white stable crystalline product. An alcoholic solution of this product (0.1%) is prepared and is used to impregnate the photosensitive paper. The impregnated paper is exposed and dried under the conditions of Example 4. A green image is thus formed on the surface of the paper as soon as the exposed paper is heated between two metal plates at 100° C for a few seconds.

EXAMPLE 10

A photosensitive paper prepared in the manner described in Example 1 is irradiated under the conditions described in Example 4. There is obtained a yellow colored image. The image-bearing paper thus obtained is immersed in an alcoholic solution identical to that of Example 9. The paper is heated for several seconds at 100° C. Formation of a green image is obtained.

EXAMPLE 11

The leuco form of the dyestuff known under the name of crystal violet (C.I. 42555) is prepared by reduction of the dyestuff with nascent hydrogen. The leuco form is isolated and a 0.1% alcoholic solution is prepared. Using the conditions of Example 9 for exposure and development, there is obtained a violet colored image.

EXAMPLE 12

A 4% solution in alcohol of diphenyl carbazone is prepared. A photosensitive paper prepared in the manner described in Example 1 is impregnated with this solution. The paper thus impregnated takes on a pink coloration. The paper is then dried and moistened. The moist paper is exposed for 30 seconds under conditions described in Example 4. This results in a decoloration of the irradiated zones by photochemical oxidation due to photolytic iodine. The image-bearing paper is dried for a few second at 100° C. There is obtained a contrasted pink image on a white ground, stable for a period for several days. It is possible, in this manner, to obtain a positive image starting from a positive original.

EXAMPLE 13

A photosensitive paper is exposed for 30 seconds in the manner described in Example 7. The image-bearing paper thus obtained is immersed in an ethanolic solution containing 1% of tetramethyl-p-diamino diphenylmethane (tetra-base), 10% formic acid and 5% water. The parts initially colored yellow instantaneously take on a blue-green coloration. Aromatic substances which have not reacted are then removed by washing with water. There is finally obtained a high contrast blue image on a white ground, stable for more than 2 months.

EXAMPLE 14

A photosensitive film prepared as described in Example 3 is exposed for 1 minutes in the manner described in Example 7. The yellow image thus obtained is developed and washed using the same method as described in Example 8. There is obtained a blue/green image on a transparent colorless ground and having a very good definition.

EXAMPLE 15

A photosensitive paper is exposed for 30 seconds in the manner described in Example 7. The image-bearing paper thus obtained is immersed in a slightly acid (HCl) 0.05% aqueous solution of palladium chloride. The parts initially colored yellow instantaneously take on a brown color. Unreacted palladium chloride is removed by washing with water. The brown image obtained is contrasted and stable.

EXAMPLE 16

Electrophotographic development of the image formed on the photosensitive film of Example 3. After the photosensitive material of Example 3 has been exposed for 1 minute to ultra violet radiation under conditions identical to those described in Example 4, the surface of the material is submitted to a corona discharge of 600 volts applied uniformly to all the surface, the face of the material opposite to the exposed face being applied to the surface of an earthed aluminum plate. There is thus formed a latent electrostatic image.

The latent electrostatic image is finally developed by the process known as "cascade" using a dry "toner", charged beforehand, and the image is fixed by infra red heating for a time sufficient to fuse the toner.

EXAMPLE 17

A piece of the photosensitive paper prepared in the manner described in Example 1 is exposed for 2 minutes to solar radiation, certain parts of the sheet being masked by means of a perforated mask.

There is obtained a yellow colored image on a white ground. The optical density of the exposed parts of the sheet is 0.17 and that of the non-exposed parts is 0.12.

While the invention has been illustrated with specific, examples, it is apparent that variations and modifications of the invention can be made.

What is claimed is:

1. Photosensitive material comprising a substrate at least one surface portion of which contains uniformly distributed 2,3-di-(2,3-diiodopropoxy)-propyl cellulose.

2. Photosensitive material according to claim 1 in which said substrate is a sheet of paper containing fibers of 2,3-di-(2,3-diiodopropoxy)-propyl cellulose.

3. Photosensitive material according to claim 1 in which said substrate is a sheet of paper formed from a mixture of paper-forming cellulose fibers and fibers of 2,3-di-(2,3-diiodopropoxy)-propyl cellulose.

4. Photosensitive material according to claim 1 in which said substrate is a sheet comprising a film of at least one polymeric film-forming material having 2,3-di-(2,3-diiodopropoxy)-propyl cellulose distributed therein.

5. Photosensitive material according to claim 1 wherein said substrate is a sheet of cellulosic polymer film containing 2,3-di-(2,3-diiodopropoxy)-propyl cellulose.

6. Photosensitive material according to claim 5 wherein said cellulosic polymer is regenerated from a solution of 2,3-di-(2,3-diiodopropoxy)-propyl cellulose.

7. Photosensitive material according to claim 6 wherein said cellulosic polymer is regenerated from a mixture of a solution of 2,3-di-(2,3-diiodopropoxy)-propyl cellulose and a solution of cellulose.

8. Method of forming an image on the photosensitive material of claim 1, which comprises exposing the surface of said photosensitive material to activating electromagnetic radiation the intensity of which is modulated according to the contours of the selected image, for a period of time sufficient to cause the appearance of said image in visible form on the surface of said material.

9. Method according to claim 8 wherein said activating electromagnetic radiation is ultraviolt radiation.

10. Method according to claim 8 wherein said activating electromagnetic radiation is solar radiation.

11. Method according to claim 8 wherein the image is formed as a result of the formation of iodine in radical, ionic or molecular form, and wherein a compound which reacts with said iodine to form a colored compound is brought into contact with the surface of said photosensitive material, whereby the formed image is modified in color.

12. Method according to claim 11 wherein said compound is an organic compound which reacts by photochemical oxidation with said iodine.

13. Method according to claim 12 wherein said organic compound is an aromatic amine.

14. Method according to claim 12 wherein said organic compound is a leuco form of a dyestuff selected from the group consisting of dyestuffs of the diarylmethane and triarylmethane dyestuffs.

15. Method according to claim 13 wherein said organic compound is a dyestuff which becomes decolorized by photochemical oxidation.

16. Method according to claim 11 wherein said compound is an organic compound which is chemically oxidized by molecular iodine.

17. Method according to claim 11 wherein said organic compound is selected from the group consisting of aromatic amines, diarylmethane dyestuffs and triarylmethane dyestuffs which are decolorized by oxidation by molecular iodine.

18. Method according to claim 11 wherein said compound is tetramethyl-p-diamino-diphenyl-methane which is oxidized by the periodate ion.

19. Method according to claim 11 wherein said compound is palladium chloride which with the iodide ion forms palladium iodide.

20. Method of forming an image on the photosensitive material of claim 1, which comprises exposing said surface portion of said photosensitive material to activating electromagnetic radiation, applying an electrostatic charge to said surface, contacting the opposite surface of said photosensitive material with a substrate of high electrical conductivity so as to form a latent image on said photosensitive material, and materializing said latent image by means of a toner.

* * * * *